US011724491B2

(12) United States Patent
Adachi et al.

(10) Patent No.: US 11,724,491 B2
(45) Date of Patent: Aug. 15, 2023

(54) LIQUID EJECTING DEVICE, CONTROL METHOD FOR LIQUID EJECTING DEVICE AND CONTROL PROGRAM FOR LIQUID EJECTING DEVICE

(71) Applicant: Seiko Epson Corporation, Tokyo (JP)

(72) Inventors: Hirohisa Adachi, Matsukawa-machi (JP); Shuji Wakumoto, Matsumoto (JP); Yoichiro Maki, Shiojiri (JP); Hiroki Hirata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/475,761

(22) Filed: Sep. 15, 2021

(65) Prior Publication Data

US 2022/0088919 A1 Mar. 24, 2022

(30) Foreign Application Priority Data

Sep. 18, 2020 (JP) ..... 2020-157424

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC .... B41J 11/008; B41J 2/04586; B41J 2/0451; B41J 11/0035; B41J 13/0009; B41J 2/04508
See application file for complete search history.

(56) References Cited

U.S. PATENT DOCUMENTS

2020/0108596 A1* 4/2020 Tsukada ..... B41J 2/0451

FOREIGN PATENT DOCUMENTS

| | | |
|---|---|---|
| JP | 2005-004259 | 1/2005 |
| JP | 2018-165023 | 10/2018 |

* cited by examiner

*Primary Examiner* — Jannelle M Lebron
(74) *Attorney, Agent, or Firm* — Workman Nydegger

(57) ABSTRACT

A recording system includes an ejecting unit, a punch unit, and a control unit. The ejecting unit ejects ink onto a sheet transported by a transport unit to form an image. The punch unit forms two through holes aligned in a Y direction with respect to the sheet. The control unit controls ejection of the ink based on image data. When the two through holes are formed in the sheet, the control unit divides a region where an image can be formed into a first region and a second region that is aligned with the first region in a T direction and in which the two through holes are formed. The control unit causes the ejecting unit to eject the ink to form a part of the image in the first region, and causes the ejecting unit not to eject the ink in the second region.

8 Claims, 12 Drawing Sheets

DT

| SHEET THICKNESS [mm] | DIMENSION SETTING OF SECOND REGION IN TRANSPORT DIRECTION | | |
|---|---|---|---|
| | LOWER LIMIT [mm] | OPTIMAL VALUE [mm] | UPPER LIMIT VALUE [mm] |
| 0.05 | 20 | 25 | 50 |
| 0.10 | 15 | 22 | 40 |
| 0.15 | 13 | 20 | 30 |

FIG. 6

LIQUID EJECTING DEVICE, CONTROL METHOD FOR LIQUID EJECTING DEVICE AND CONTROL PROGRAM FOR LIQUID EJECTING DEVICE

The present application is based on, and claims priority from JP Application Serial Number 2020-157424, filed Sep. 18, 2020, the disclosure of which is hereby incorporated by reference herein in its entirety.

BACKGROUND

1. Technical Field

The present disclosure relates to a liquid ejecting device, a control method for a liquid ejecting device, and a control program for a liquid ejecting device.

2. Related Art

A printing data processing device described in JP 2005-4259 A, when a printing region overlaps a holed portion, converts print data to exclude the overlapping portion from the printing region so that a portion of the printing region overlapping the holed portion is not printed, and sends the converted print data and generated process portion data to a printing apparatus. The printing apparatus including a processing head performs printing and holing in parallel based on the received print data and processing portion data.

In the configuration of JP 2005-4259 A, when a mounting position of the processing head is shifted from a set position, there is a possibility that, even when an overlapping portion is excluded from an image on a medium, a position of a hole formed in the portion from which the image is excluded is shifted from the image, and a position shift of the hole may be conspicuous.

SUMMARY

A liquid ejecting device according to the present disclosure for solving the above-described problem includes an ejecting unit configured to eject liquid onto a medium transported by a transport unit to form an image, a hole forming unit configured to form a plurality of through holes, arranged in a width direction intersecting a transport direction of the medium, in the medium onto which the liquid was ejected from the ejecting unit, and a control unit configured to control ejection of the liquid from the ejecting unit based on image data, wherein the control unit, when the plurality of through holes are formed in the medium, divides a region in the medium in which an image can be formed based on the image data into a first region, and a second region that is aligned with the first region in the transport direction and in which the plurality of through holes are formed, causes the ejecting unit to eject the liquid based on the image data in the first region to form a part of the image, and causes the ejecting unit not to eject the liquid in the second region.

A control method for a liquid ejecting device according to the present disclosure for solving the above-described problem is a control method for a liquid ejecting device that includes an ejecting unit for ejecting liquid onto a medium transported by a transport unit to form an image, a hole forming unit for forming a plurality of through holes, arranged in a width direction intersecting a transport direction of the medium, in the medium onto which the liquid was ejected from the ejecting unit, and a control unit for controlling ejection of the liquid from the ejecting unit based on image data, the control method including a process of dividing, when the plurality of through holes are formed in the medium, a region in the medium in which an image can be formed based on the image data into a first region, and a second region that is aligned with the first region in the transport direction and in which the plurality of through holes are formed, and a process of causing the ejecting unit to eject the liquid based on the image data in the first region to form a part of the image, and causing the ejecting unit not to eject the liquid in the second region.

A non-transitory computer-readable storage medium storing a control program for a liquid ejecting device according to the present disclosure for solving the above-described problem is a storage medium storing a control program for a liquid ejecting device that includes an ejecting unit for ejecting liquid onto a medium transported by a transport unit to form an image, a hole forming unit for forming a plurality of through holes, arranged in a width direction intersecting a transport direction of the medium, in the medium onto which the liquid was ejected from the ejecting unit, and a control unit for controlling ejection of the liquid from the ejecting unit based on image data, the control program including a step of dividing, when the plurality of through holes are formed in the medium, a region in the medium in which an image can be formed based on the image data into a first region, and a second region that is aligned with the first region in the transport direction and in which the plurality of through holes are formed, and step of causing the ejecting unit to eject the liquid based on the image data in the first region to form a part of the image, and causing the ejecting unit not to eject the liquid in the second region.

BRIEF DESCRIPTION OF THE DRAWINGS

FIG. 6 is an example of a data table illustrating a relationship between sheet thickness, and width dimension of a set second region used in the recording system according to the present exemplary embodiment.

DESCRIPTION OF EXEMPLARY EMBODIMENTS

Figure 1:
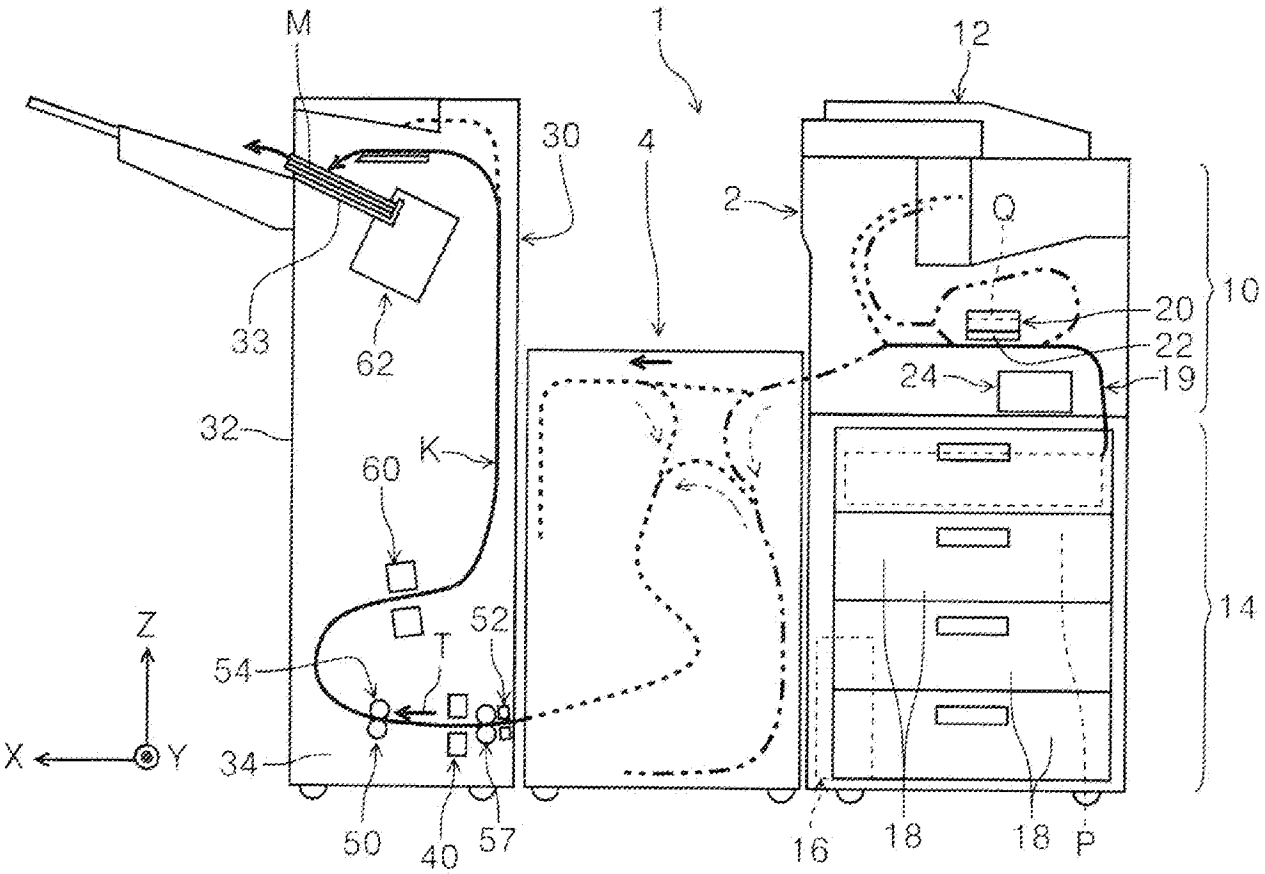
FIG. 1 is an overall view of a recording system according to the present exemplary embodiment.

Hereinafter, the present disclosure will be schematically described.

A liquid ejecting device according to a first aspect for solving the above-described problem includes an ejecting unit configured to eject liquid onto a medium transported by a transport unit to form an image, a hole forming unit configured to form a plurality of through holes, arranged in a width direction intersecting a transport direction of the medium, in the medium onto which the liquid was ejected from the ejecting unit, and a control unit configured to control ejection of the liquid from the ejecting unit based on image data, wherein the control unit, when the plurality of through holes are formed in the medium, divides a region in the medium in which an image can be formed based on the image data into a first region, and a second region that is aligned with the first region in the transport direction and in which the plurality of through holes are formed, causes the ejecting unit to eject the liquid based on the image data in the first region to form a part of the image, and causes the ejecting unit not to eject the liquid in the second region.

According to the present aspect, in the first region of the medium, the liquid is ejected from the ejecting unit based on the image data to form a part of the image.

On the other hand, in the second region of the medium, the ejecting unit does not eject the liquid, and thus the image is not formed in a band shape entirely in the width direction.

Here, even when respective positions of the plurality of through holes are shifted from respective set positions when the hole forming unit forms the plurality of through holes in the second region of the medium, the image is not formed in the second region, so a position of the image and the respective positions of the plurality of through holes are not compared, and a position shift of the plurality of through holes can be prevented from being conspicuous.

Furthermore, according to the present aspect, of the image data, image data corresponding to the second region is removed in a band shape, therefore, the control unit does not need to perform a process of locating the respective positions of the plurality of through holes, and a process of removing the image data in accordance with the respective positions of the plurality of through holes, therefore, a load of the control unit can be reduced.

A liquid ejecting device according to a second aspect is the liquid ejecting device according to the first aspect, that includes an operation unit configured to enable setting of a dimension in the transport direction of the second region, wherein the control unit performs division into the first region and the second region so that a dimension in the transport direction of the second region is a set dimension set by the operation unit.

According to the present aspect, the dimension in the transport direction of the second region can be freely set by the operation unit, and thus the image in the first region along an intention of the user can be obtained.

A liquid ejecting device according to a third aspect is the liquid ejecting device according to the second aspect, wherein the operation unit is configured to enable selection of whether to shift the position of the image in the transport direction, and the control unit, when the shift of the position of the image is selected through the operation unit, causes the ejecting unit to eject the liquid so that the position of the image formed in the first region is shifted by the set dimension.

According to the present aspect, the control unit, when the shift of the position of the image is selected through the operation unit, causes the ejecting unit to eject the liquid so that the position of the image formed in the first region is shifted by the set dimension. As a result, there is no need to set an amount of shift in the transport direction of the image formed in the first region each time, and thus convenience of the liquid ejecting device is improved.

A liquid ejecting device according to a fourth aspect is the liquid ejecting device according to any one of the first to third aspects, wherein the control unit includes a storage unit for storing a data table, and the storage unit stores, in the data table, thickness data of the medium, and dimension data in the transport direction of the second region corresponding to the thickness data.

According to the present aspect, when the medium having a different thickness is used, the dimension in the transport direction of the second region in accordance with the medium can be determined, based on a relationship between the thickness data of the medium stored in the storage unit, and the dimension data in the transport direction of the second region corresponding to the thickness data.

A liquid ejecting device according to a fifth aspect is the liquid ejecting device according to any one of the first to fourth aspects, that includes a display unit that is capable of displaying the data table and with which the dimension data can be selected, wherein the control unit stores the dimension data selected in the display unit.

According to the present aspect, dimension data as desired by a user can be set within a range of the data table.

A liquid ejecting device according to a sixth aspect is the liquid ejecting device according to any one of the first to fifth aspects, that includes a modification unit capable of modifying a position in the transport direction of the medium transported to the hole forming unit, wherein the control unit is configured to accept input of correction data for correcting a position in the transport direction of the medium, and operates the modification unit based on the input correction data, to correct the position in the transport direction of the medium.

According to the present aspect, the modification unit corrects the position in the transport direction of the medium, based on the correction data input to the control unit. As a result, a position shift of the image with respect to the plurality of through holes can be corrected uniformly, in the transport direction.

A liquid ejecting device according to a seventh aspect is the liquid ejecting device according to any one of the first to sixth aspects, wherein the control unit, in a state in which the liquid ejected from the ejecting unit onto the medium is undried, causes the transport unit to transport the medium so that the through hole is formed in the medium.

According to the present aspect, compared to a configuration in which after the control unit waits for the liquid to be dried, and controls the hole forming unit to form the plurality of through holes in the medium, a time required for the plurality of through holes to be formed in the medium after the liquid is ejected from the ejecting unit is shortened, so it is possible to increase throughput of image formation on the medium in the liquid ejecting device.

A liquid ejecting device according to an eighth aspect is the liquid ejecting device according to any one of the first to seventh aspects, that includes an inspection unit configured to inspect a state of the ejecting unit, wherein the control unit causes the inspection unit to inspect a state of the ejecting unit, in a time in which the ejecting unit faces the second region of the medium.

According to the present aspect, compared to a configuration in which the image is formed in the second region, a total time required for image forming processing to form the image on the medium and inspection processing of the state of the ejecting unit by the inspection unit is shortened, as a result, throughput of image formation on the medium in the liquid ejecting device can be increased.

A control method for a liquid ejecting device according to a ninth aspect is a control method for a liquid ejecting device that includes an ejecting unit for ejecting liquid onto a medium transported by a transport unit to form an image, a hole forming unit for forming a plurality of through holes, arranged in a width direction intersecting a transport direction of the medium, in the medium onto which the liquid was ejected from the ejecting unit, and a control unit for controlling ejection of the liquid from the ejecting unit based on image data, the control method including a process of dividing, when the plurality of through holes are formed in the medium, a region in the medium in which an image can be formed based on the image data into a first region, and a second region that is aligned with the first region in the transport direction and in which the plurality of through holes are formed, and a process of causing the ejecting unit to eject the liquid based on the image data in the first region to form a part of the image, and causing the ejecting unit not to eject the liquid in the second region.

According to the present aspect, an action effect similar to that in the liquid ejecting device according to the first aspect can be obtained.

A control program for a liquid ejecting device according to a tenth aspect is a control program for a liquid ejecting device that includes an ejecting unit for ejecting liquid onto a medium transported by a transport unit to form an image, a hole forming unit for forming a plurality of through holes, arranged in a width direction intersecting a transport direction of the medium, in the medium onto which the liquid was ejected from the ejecting unit, and a control unit for controlling ejection of the liquid from the ejecting unit based on image data, the control program including a step of dividing, when the plurality of through holes are formed in the medium, a region in the medium in which an image can be formed based on the image data into a first region, and a second region that is aligned with the first region in the transport direction and in which the plurality of through holes are formed, and a step of causing the ejecting unit to eject the liquid based on the image data in the first region to form a part of the image, and causing the ejecting unit not to eject the liquid in the second region.

According to the present aspect, an action effect similar to that in the liquid ejecting device according to the first aspect can be obtained.

Hereinafter, an exemplary embodiment, which is an example of a liquid ejecting device, a control method for a liquid ejecting device, and a control program for a liquid ejecting device according to the present disclosure, will be described in detail.

In FIG. 1, a recording system 1, which is an example of the liquid ejecting device, is illustrated. The recording system 1 is configured as an inkjet device for recording by ejecting ink Q, which is an example of liquid, onto a sheet P, which is an example of a medium.

In an X-Y-Z coordinate system illustrated in each figure, an X direction is a device width direction, a Y direction is a device depth direction, and a Z direction is a device height direction. The X direction, the Y direction, and the Z direction are orthogonal to each other. The Y direction is an example of a width direction of the sheet P.

When the recording system 1 is viewed from front, and left and right are distinguished from each other with respect to a center in the device width direction, left is referred to as a +X direction, and right is referred to as a −X direction. When front and back are distinguished from each other with respect to a center in the device depth direction, front is referred to as a +Y direction, and back is referred to as a −Y direction. When up and down are distinguished from each other with respect to a center in the device height direction, up is referred to as a +Z direction, and down is referred to as a −Z direction.

The recording system 1 has, in order in the +X direction, a recording unit 2, an intermediate unit 4, and a post-processing unit 30. Note that, in the recording system 1, the recording unit 2, the intermediate unit 4, and the post-processing unit 30 are mechanically and electrically coupled to each other. The intermediate unit 4 transports the sheet P fed from the recording unit 2 to the post-processing unit 30.

Note that, the recording system 1 is configured to perform post-processing described below on the sheet P on which information is recorded in an image forming unit 10 described below.

The recording system 1 may further include an operation unit 15 (FIG. 2) operated by a user, and a display unit 17 (FIG. 2) on which various types of information of the recording system 1 are displayed. In the present exemplary embodiment, as an example, the operation unit 15 and the display unit 17 are provided in the recording unit 2.

As an example, the operation unit 15 and the display unit 17 are constituted by one touch panel, and are configured to enable operations of each unit of the recording system 1, and configured to enable setting of various operating parameters. The operating parameters are displayed on the touch panel.

The display unit 17 is configured to display a data table DT (FIG. 6) described later on the touch panel, and is configured so that a second dimension L2*b* (FIG. 4) described later can be selected from the data table DT.

In the operation unit 15, the second dimension L2*b* described later may be set. Further, the operation unit 15 may be configured to enable selection of whether to shift a position of an image G described below (FIG. 5) in a transport direction in the sheet P or not. The selection is performed by pressing a button displayed on the touch panel.

In the following description, a transport direction of the sheet P is referred to as a T direction, and illustrated by an arrow T. Note that, the T direction is not constant, and an angle with respect to a horizontal direction varies depending on a position of the sheet P in a transport path K.

Figure 2:
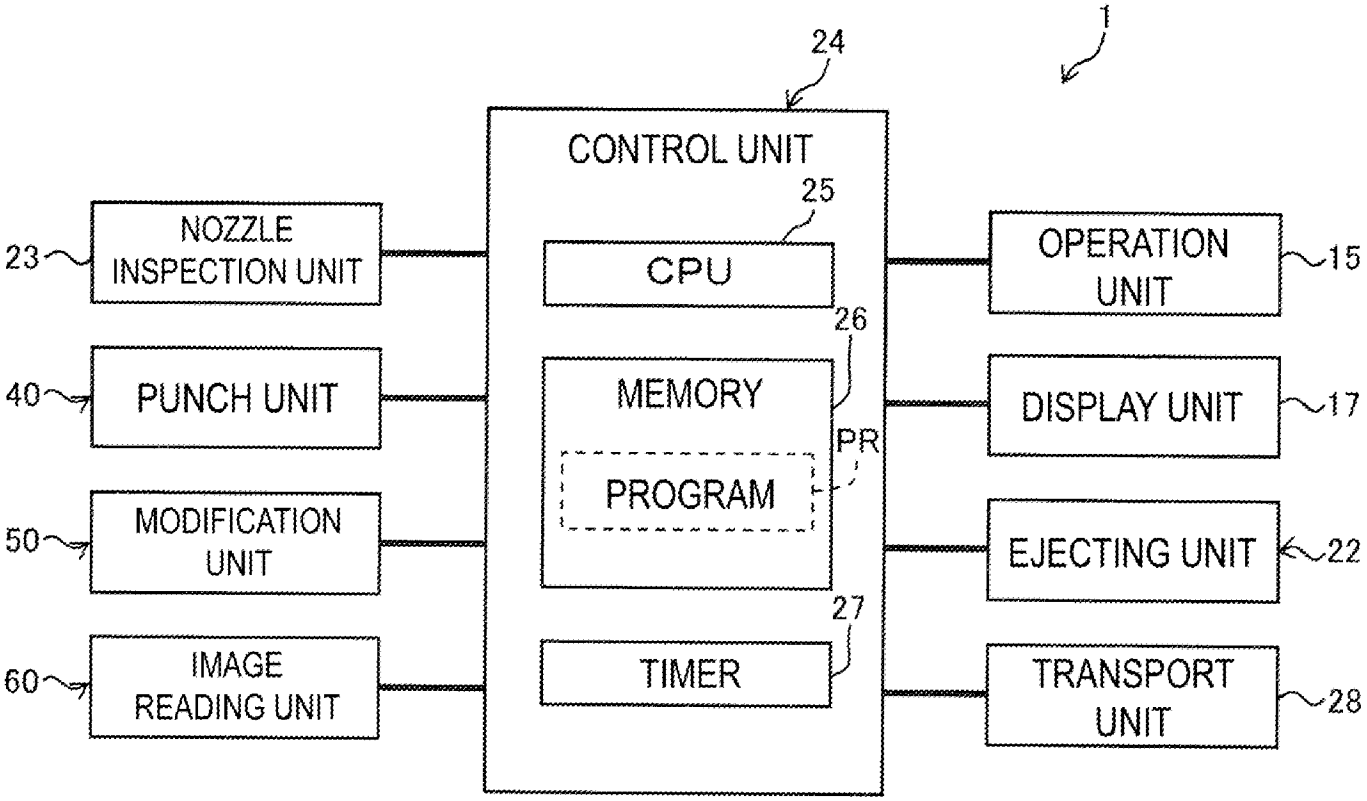
FIG. 2 is a block diagram of main units of the recording system according to the present exemplary embodiment.

The recording unit 2 records various types of information on the sheet P being transported. The sheet P is formed in a sheet shape. Further, the recording unit 2 may include the image forming unit 10, a scanner unit 12, a cassette accommodation unit 14, and a power supply 16. As an example, the image forming unit 10 may be configured to include a recording head 20, a control unit 24, and a transport unit 28 (FIG. 2).

The recording head 20 is configured as a line head, as an example. Further, the recording head 20 includes an ejecting unit 22 including a plurality of nozzles (not illustrated).

The ejecting unit 22 forms an image by ejecting the ink Q onto the sheet P being transported. As an example, the ejecting unit 22 may include a nozzle inspection unit 23 (FIG. 2).

The nozzle inspection unit 23 is an example of an inspection unit for inspecting a state of the ejecting unit 22. Specifically, when the ink Q is ejected from the ejecting unit 22, the nozzle inspection unit 23 inspects a state of the nozzle, based on a non-ejection waveform that is a fine vibration waveform obtained by residual vibration inside a pressure chamber (not illustrated). The state of the nozzle means, for example, a state of change in viscosity of the ink Q inside the nozzle. In other words, in the inspection of the state of the nozzle, a clogging state of the ink Q inside the nozzle is inspected. Also, as the state of the nozzle, a state of whether paper powder such as the sheet P adheres thereto or not may be inspected.

As illustrated in FIG. 2, the control unit 24 includes a CPU (Central Processing Unit) 25 that functions as a computer, a memory 26, a timer 27 that can count a time or a time of day based on each time point, and a storage (not illustrated). Furthermore, the control unit 24 controls various operations in each unit of the recording system 1. Control by the control unit 24 includes control of operation of the punch unit 40 described below (FIG. 1). Furthermore, based on image data DG (FIG. 5) of the image G, the control unit 24 controls ejection of the ink Q from the ejecting unit 22.

Various types of data including a program PR executed by the CPU 25 are stored in the memory 26. In other words, the memory 26 is an example of a recording medium in which the computer readable program PR is stored. Other examples of the recording medium include a CD (Compact Disc), a DVD (Digital Versatile Disc), a Blu-ray disk, a USB (Universal Serial Bus) memory, and the like. In addition, in a part of the memory 26, the program PR can be decompressed.

The program PR is a program for causing the CPU 25 to perform each step described below in the recording system 1.

Figure 4:
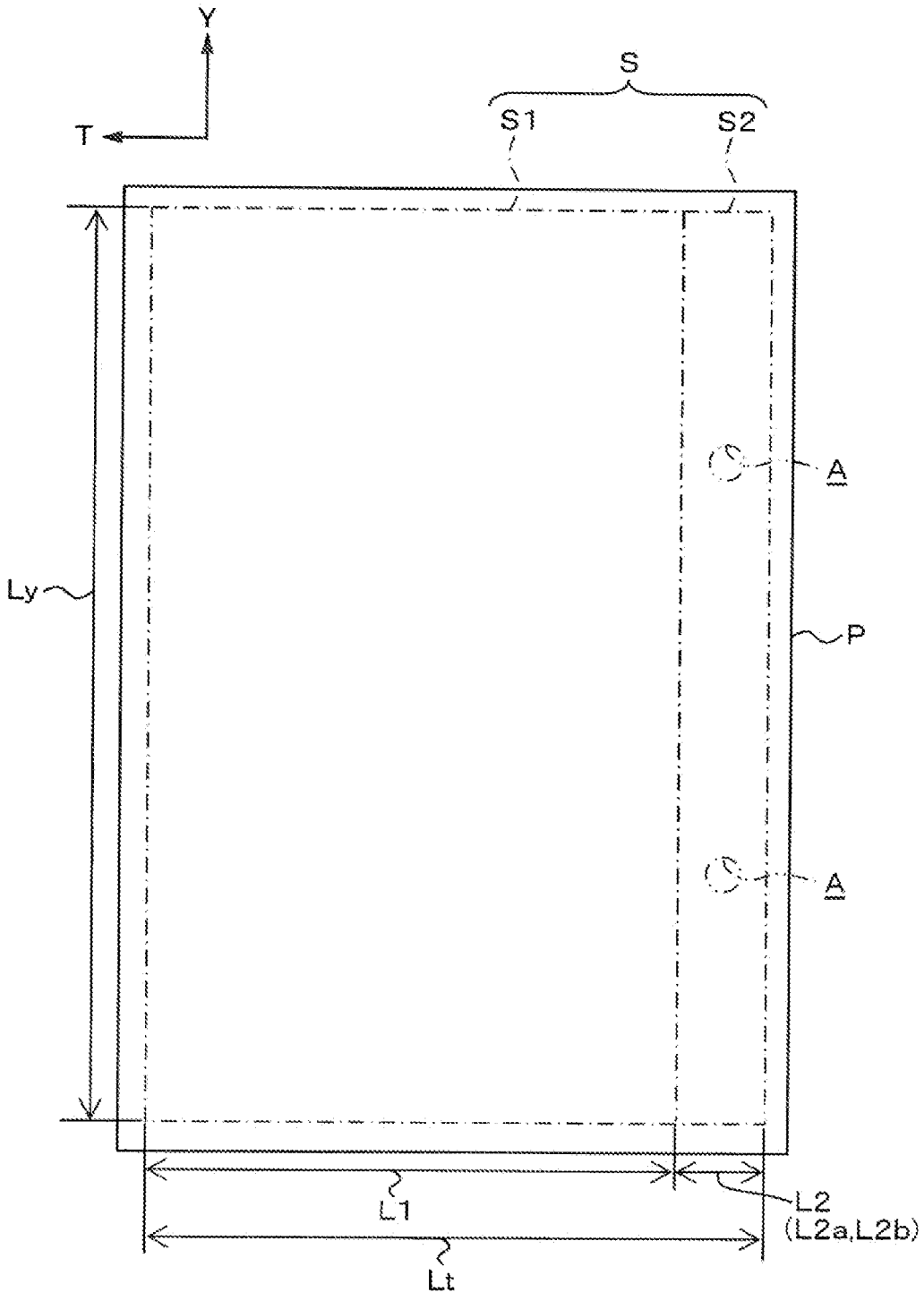
FIG. 4 is a plan view illustrating a region in which an image can be formed in a sheet used in the recording system according to the present exemplary embodiment.

Further, the memory 26 is an example of a storage unit, and stores the data table DT (FIG. 6). Details of the data table DT are described below. Furthermore, the memory 26 stores a dimension L1 and a first dimension L2*a* described below (FIG. 4).

The transport unit 28 is provided throughout the recording system 1, and transports the sheet P from a transport path 19 to the transport path K described below. Further, the transport unit 28 is configured to include a plurality of roller pairs including a first roller pair 54 and a second roller pair 57 (FIG. 3) described later, and a plurality of motors (not illustrated) that rotationally drive the plurality of roller pairs. Transport operation of the sheet P by the transport unit 28 is controlled by the control unit 24.

As illustrated in FIG. 1, the scanner unit 12 reads information of an original document (not illustrated). For image data of the original document read by the scanner unit 12, image analysis is possible in the control unit 24. In this image analysis, a through hole A (FIG. 4) described below can be identified.

The cassette accommodation unit 14 has a plurality of accommodation cassettes 18 for accommodating the plurality of sheets P. The image forming unit 10 and the cassette accommodation unit 14 form the transport path 19 through which the sheet P is transported. In the transport path 19, the sheet P is transported from the accommodation cassette 18 to a recording region of the recording head 20, and is further transported from the recording region through the intermediate unit 4 to the post-processing unit 30.

The post-processing unit 30 is an example of a post-processing device, and includes a housing 32, the punch unit 40, a modification unit 50, an image reading unit 60, and a staple unit 62. The transport path K is formed inside the housing 32. The sheet P received from the intermediate unit 4 is transported along the transport path K, and discharged to a discharge tray 33. In addition, the post-processing unit 30 performs post-processing for the sheet P. In the present exemplary embodiment, examples of the post-processing include punching processing for forming the through hole A (FIG. 4) in the sheet P in the punch unit 40, and staple processing for bundling the required number of sheets P in the staple unit 62.

The punch unit 40 is located downstream a sheet sensor 52 described below and upstream the staple unit 62, in the T direction of the transport path K. In addition, as an example, the punch unit 40 is provided in a lower unit 34, which is a site located in the −Z direction with respect to a center in the Z direction of the housing 32. Note that, a site that is a part of the transport path K and faces the punch unit 40 is along the X direction, as an example.

Figure 3:
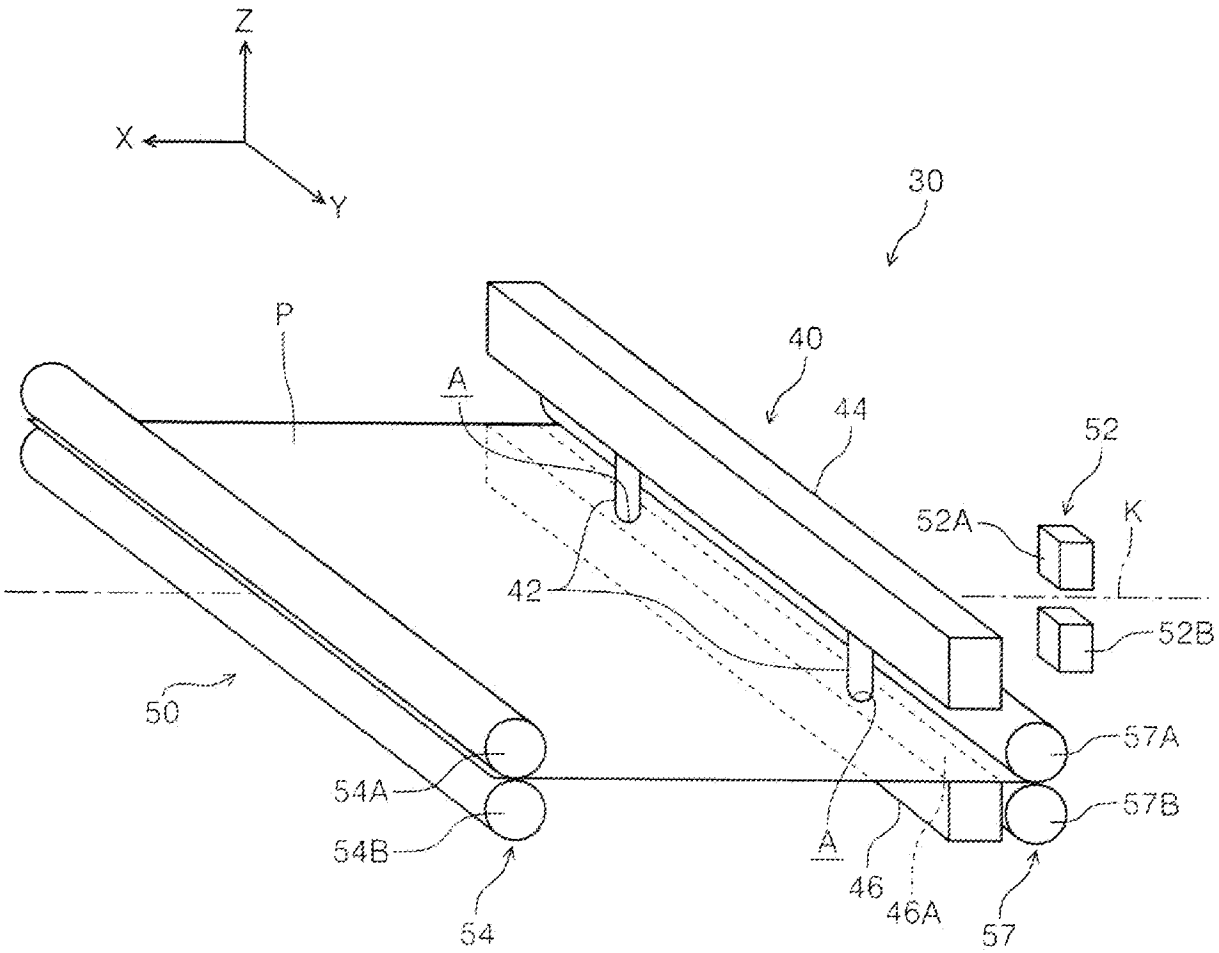
FIG. 3 is a perspective view illustrating a punch unit and a modification unit according to the present exemplary embodiment.

As illustrated in FIG. 3, the punch unit 40 is an example of a hole forming unit, and includes a punch 42, a support portion 44 that supports the punch 42, and a stand 46 on which the sheet P is placed.

The punch 42 is formed in a cylindrical shape having a central axis along the Z direction. A blade portion (not illustrated) is formed at an end portion in the −Z direction of the punch 42. In addition, two number of the punches 42 are provided as an example. The two punches 42 are arranged at intervals in the Y direction.

The support portion 44 is disposed in the +Z direction with respect to the transport path K, and supports the two punches 42 to be expandable and contractible in the Z direction. A motor (not illustrated) is provided in the support portion 44. The motor drives the two punches 42 in the Z direction.

The stand 46 is disposed in the −Z direction with respect to the transport path K. The stand 46 has an upper surface 46A on which a part of the sheet P is placed. Furthermore, a hole portion (not illustrated) is formed in the stand 46. A size and a depth of the hole portion are set to a size and a depth such that the two punch 42 penetrating the sheet P can enter therethrough, respectively. In a state in which a part of the sheet P is placed on the upper surface 46A, the two punches 42 penetrate respective parts of the sheet P while being moved in the −Z direction, thereby forming the two through holes A in the sheet P. In this way, the punch unit 40 forms the two through holes A arranged in the Y direction that intersects with the T direction of the sheet P, in the sheet P onto which the ink Q is ejected from the ejecting unit 22.

The modification unit 50 is provided in the post-processing unit 30. In addition, the modification unit 50 is configured to modify a position in the T direction of the sheet P transported to the punch unit 40. Specifically, the modification unit 50 includes, as an example, the sheet sensor 52, the first roller pair 54, and the second roller pair 57.

The sheet sensor 52 is provided upstream the second roller pair 57 in the T direction. The sheet sensor 52 includes, as an example, an emission unit 52A located in the +Z direction with respect to the transport path K, and a light receiving unit 52B located in the −Z direction with respect to the transport path K. Then, the sheet sensor 52 detects a time of passage of the sheet P at the sheet sensor 52, by determining whether light from the emission unit 52A is received by the light receiving unit 52B or not.

The first roller pair 54 is located downstream the punch unit 40 in the T direction. Further, the first roller pair 54 has a roller 54A and a roller 54B with a direction of a central axis along the Y direction. The roller 54A and the roller 54B are driving rollers, and are rotationally driven by a motor (not illustrated). The roller 54A and the roller 54B transport the sheet P by sandwiching the sheet P in the Z direction while being rotated.

The second roller pair 57 is located downstream the sheet sensor 52 and upstream the punch unit 40, in the T direction. Further, the second roller pair 57 has a roller 57A and a roller 57B with a direction of a central axis along the Y direction. The roller 57A and the roller 57B are driven rollers that sandwich the sheet P in the Z direction, and are rotated as the sheet P moves.

In the direction T, a position of the first roller pair 54 and a position of the second roller pair 57 are determined so that the first roller pair 54 sandwiches one end portion of the sheet P in the +T direction, and the second roller pair 57 sandwiches another end portion of the sheet P in the −T direction. As a result, in a state where the sheet P is subjected to tension between the first roller pair 54 and the second roller pair 57, the through hole A is formed by the punch unit 40. In addition, a tip position of the sheet P in the T direction can be modified by rotating and stopping the first roller pair 54 and the second roller pair 57.

As illustrated in FIG. 1, the image reading unit 60 is disposed downstream the first roller pair 54 in the T direction. In addition, the image reading unit 60 is configured as a contact image sensor module (CISM) as an example. The image reading unit 60 is capable of reading respective images on both sides of the sheet P. Image data read by the image reading unit 60 is sent to the control unit 24. The control unit 24 detects a position of an image and respective positions of the two through holes A in the sheet P by performing image analysis based on the obtained image data. In addition, the control unit 24 acquires a correction data amount for a position of the sheet P facing the punch unit 40, by determining a difference between respective preset positions of the two through holes A, and the respective positions of the two through holes A obtained by the image analysis.

The staple unit 62 forms a sheet bundle M by driving a staple (not illustrated) into the plurality of sheets P stacked at an end of the transport path K.

As illustrated in FIG. 4, in the sheet P, a region in which the image G (FIG. 5) can be formed based on the image data DG is referred to as a region S. The region S is a virtual region, and when viewed from the Z direction, is set to a rectangular shape having a dimension in the Y direction greater than a dimension in the T direction. The dimension in the T direction of the region S is Lt (mm), and the dimension in the Y direction of the region S is Ly (mm). In the present exemplary embodiment, as an example, the region S is set by the control unit 24 (FIG. 2) as a region obtained by excluding an outer edge portion of the sheet P.

When the two through holes A are formed in the sheet P, the control unit 24 divides the region S into a first region S1 and a second region S2. Specifically, the control unit 24 performs division into the first region S1 and the second region S2 in the T direction, such that a dimension in the T direction of the second region S2 is set by the operation unit 15 (FIG. 2) or is set to a set dimension L2 [mm] stored in advance in the memory 26 (FIG. 2).

The first region S1 is a region in which the image G is formed. Further, the first region S1 is a region having a dimension Ly [mm] in the Y direction and the dimension L1 [mm] in the T direction. L1=Lt−L2. The second region S2 is a region that is aligned with the first region S1 in the T direction and in which the two through holes A are formed. Further, the second region S2 is a region in which the image G is not formed.

Note that, in the present exemplary embodiment, the second region S2 is located upstream the first region S1 in the T direction. Also, the second region S2 is a region having the dimension Ly in the Y direction, and the set dimension L2 of the dimension in the T direction. In other words, the second region S2 is a band-like region corresponding to an overall width in the Y direction of the image data DG.

In the present exemplary embodiment, for the set dimension L2, a dimension stored in advance in the memory 26 of the control unit 24 is a first dimension L2*a*, and a dimension set by the operation unit 15 is a second dimension L2*b*, and the dimensions are distinguished from each other. Note that, as an example, the set dimension L2 is a dimension having a size obtained by adding an error ΔL [mm] (not illustrated) to a diameter of the through hole A, and is set such that an entirety of the two through holes A fit within the second region S2. The error ΔL is set based on an amount of position shift of the punch 42 (FIG. 3) assumed with respect to a position at which the through hole A is to be formed.

Figure 5:
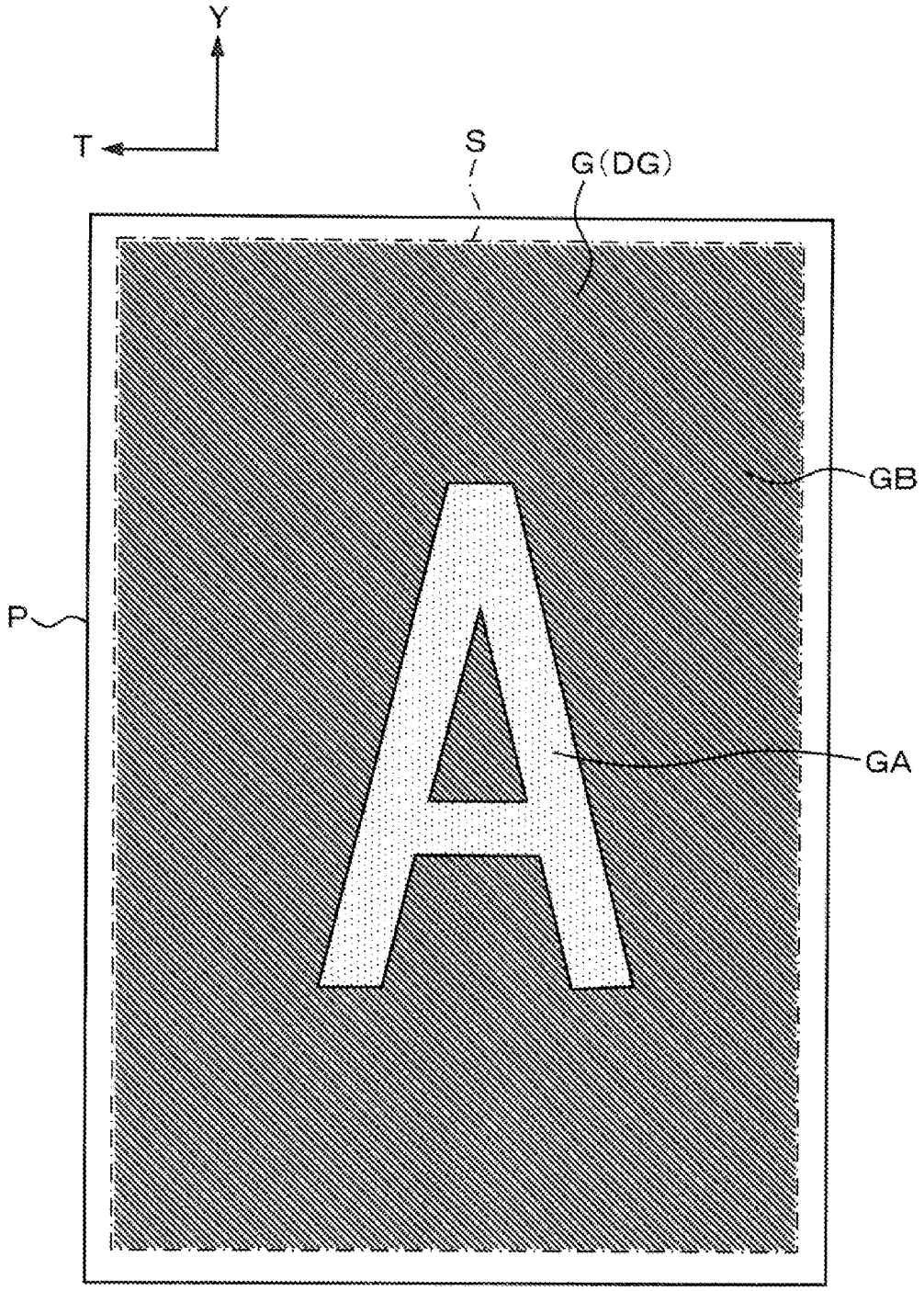
FIG. 5 is a plan view illustrating an example of image data for forming an image in the recording system according to the present exemplary embodiment.

As illustrated in FIG. 5, the image G based on the image data DG is formed in the entire region S, as an example. In addition, as an example, the image G is constituted by a main image portion GA and a background portion GB around the main image portion GA. As an example, the main image portion GA is constituted by an image of an alphabet A represented by a color other than black. As an example, the background portion GB is an image entirely filled in black. Note that, in FIG. 5, the background portion GB is not filled in black, but is indicated by diagonal lines.

Here, control by the control unit 24 will be described in further detail. Note that, for the recording system 1, reference is made to FIG. 1 to FIG. 5 for the configuration described above, and the description of the individual figure numbers is omitted.

The control unit 24 causes the ejecting unit 22 to eject the ink Q based on the image data DG in the first region S1 to form a part of the image G. Furthermore, in the second region S2, the control unit 24 causes the ejecting unit 22 not to eject the ink Q. That is, the control unit 24 causes a remaining part of the image G not to be formed in the second region S2. As an example of a method in which the remaining part of the image G is not caused to be formed in the second region S2, in the present exemplary embodiment, the control unit 24 trims data of the remaining part of the image G.

Figure 7:
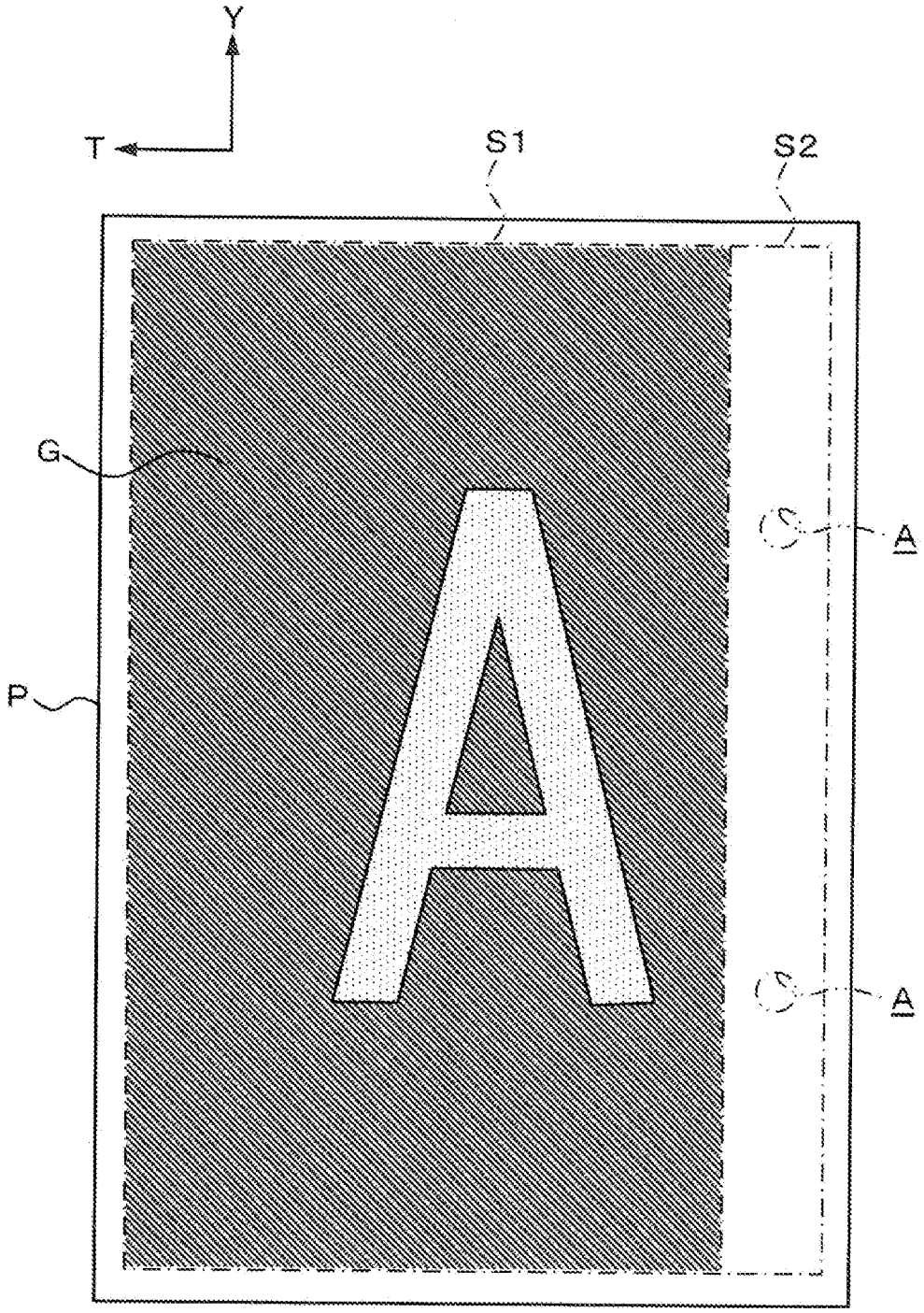
FIG. 7 is a plan view illustrating a sheet on which an image and through holes are formed in the recording system according to the present exemplary embodiment.

As illustrated in FIG. 7, in the sheet P after the image G is formed, the image G in a part corresponding to the second region S2 is not formed, and the image G of a part corresponding to the first region S1 is formed. Thus, in a state before the through hole A is formed, the ink Q does not adhere to the second regions S2.

The control unit 24, when a shift in the T direction of a position of the image G is selected through the operation unit 15, may cause the ejecting unit 22 to eject the ink Q so that the position of the image G formed in the first region S1 is shifted by the set dimension L2.

Figure 8:
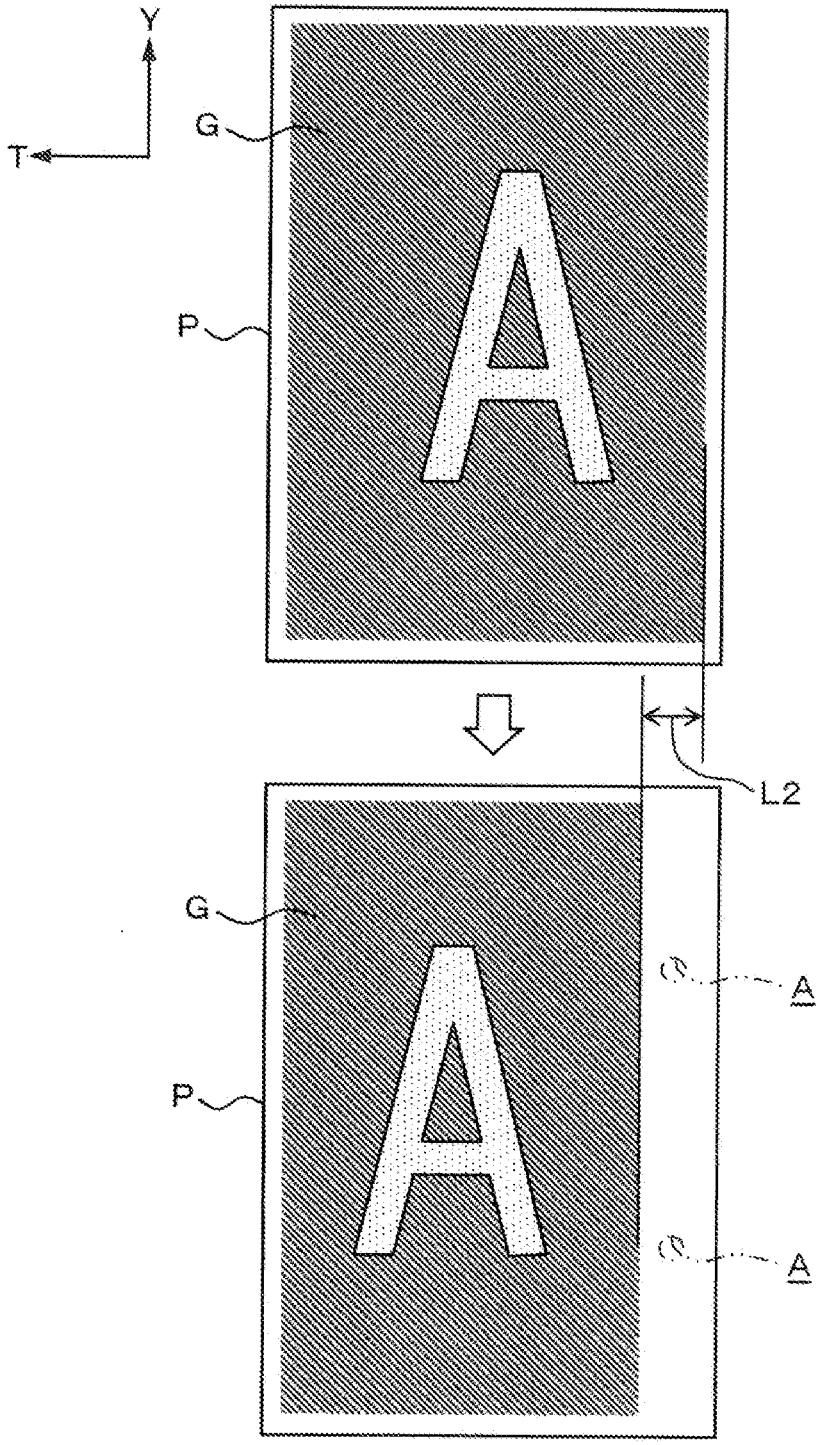
FIG. 8 is a plan view illustrating a state of a sheet in which a position of image data is shifted and through holes are formed in the recording system according to the present exemplary embodiment.

As illustrated in FIG. 8, specifically, a part of the image G is formed on the sheet P, so that a position of an upstream end in the T direction of the image G is shifted downstream in the T direction by the set dimension L2 [mm]. Note that, it is assumed that a width in the T direction of the sheet P is not changed. Thus, by shifting the image G in the T direction, an end portion downstream in the T direction of the image G will be deleted within a range corresponding to the set dimension L2. In this way, the image G is formed so that the position of the image G is shifted in the T direction, so that the image G is not formed in the second region S2.

The control unit 24 is configured to accept input of correction data for correcting the position of the sheet P in the T direction, and may correct the position of the sheet P in the transport direction by operating the modification unit 50 based on the input correction data. As an example, the correction data is data input from the operation unit 15, and is a data of a length LB [mm], which is an amount of shift in the T direction. Note that, as the correction data, correction data determined from image analysis by the image reading unit 60 may be used, instead of the correction data input from the operation unit 15.

Figure 9:
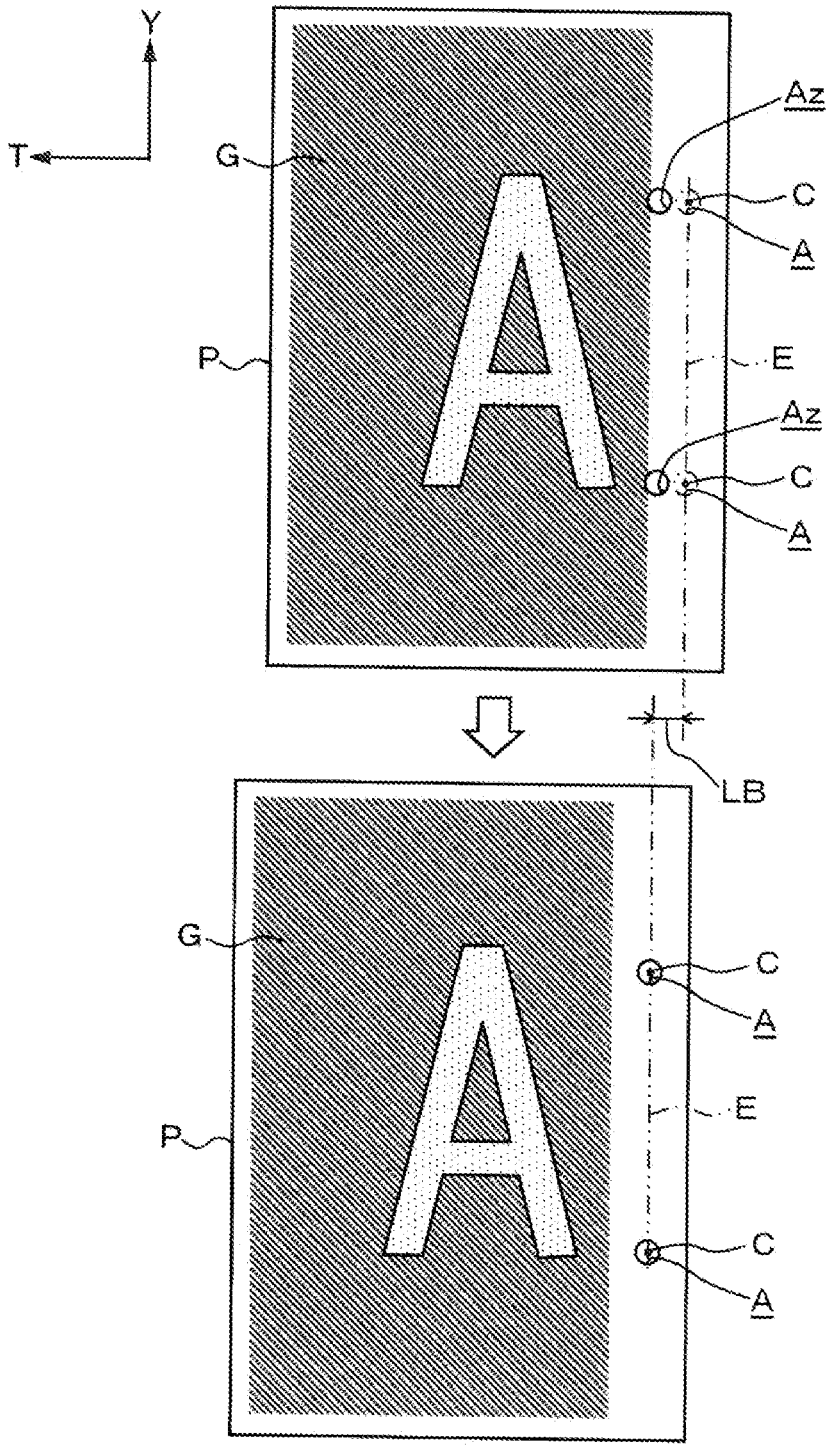
FIG. 9 is a plan view illustrating a state in which a position in a transport direction of the sheet in which the through holes are formed is corrected in the recording system according to the present exemplary embodiment.

As illustrated in FIG. 9, specifically, the position of the sheet P in a state of facing the punch unit 40 is shifted downstream in the T direction by the length LB. In other words, the position of the sheet P is shifted so that an imaginary line E that connects respective centers C of the two through holes A is shifted by the length LB in the T direction in accordance with a position of a punch 42 (FIG. 3). This causes the two through holes A to be formed in a substantially central portion in the T direction of the second region S2 (FIG. 4).

The control unit 24 may cause the transport unit 28 to transport the sheet P, so that the through hole A is formed in the sheet P, while the ink Q ejected from the ejecting unit 22 onto the sheet P is undried. The state in which the ink Q is undried means a state in which a moisture content [mass %] of the sheet P after the image G is formed is not less than a moisture content [mass %] of the sheet P before the image G is formed.

Note that, in the present exemplary embodiment, the ink Q is in the undried state, as an example, when a time from when the ejecting unit 22 starts ejecting the ink Q to when the sheet P faces the punch unit 40 is within 6 [seconds].

In addition, the control unit 24 causes the nozzle inspection unit 23 to inspect the state of the ejecting unit 22, within a time during which the ejecting unit 22 faces the second region S2 of the sheet P. As described above, the state of the ejecting unit 22 is a clogging state of the ink Q inside the nozzle.

An example of the data table DT is illustrated in FIG. 6. The memory 26 (FIG. 2) may store a sheet thickness and a width dimension in the Y direction of the second region S2 in the data table DT. The sheet thickness is an example of thickness data of the sheet P. The width dimension is an example of dimension data in the T direction of the second region S2 corresponding to the sheet thickness.

In FIG. 6, as an example, a lower limit value, an optimal value, and an upper limit value of the width dimension in the Y direction of the second region S2 are illustrated in respective cases where the sheet thickness is 1, 2, and 3 [mm].

Next, description is made of effects of the recording system 1 according to the present exemplary embodiment. Note that, for each unit constituting the recording system 1, each image, and each region, reference is made to FIG. 1 to FIG. 9, and the description of the individual figure numbers is omitted.

Figure 10A:
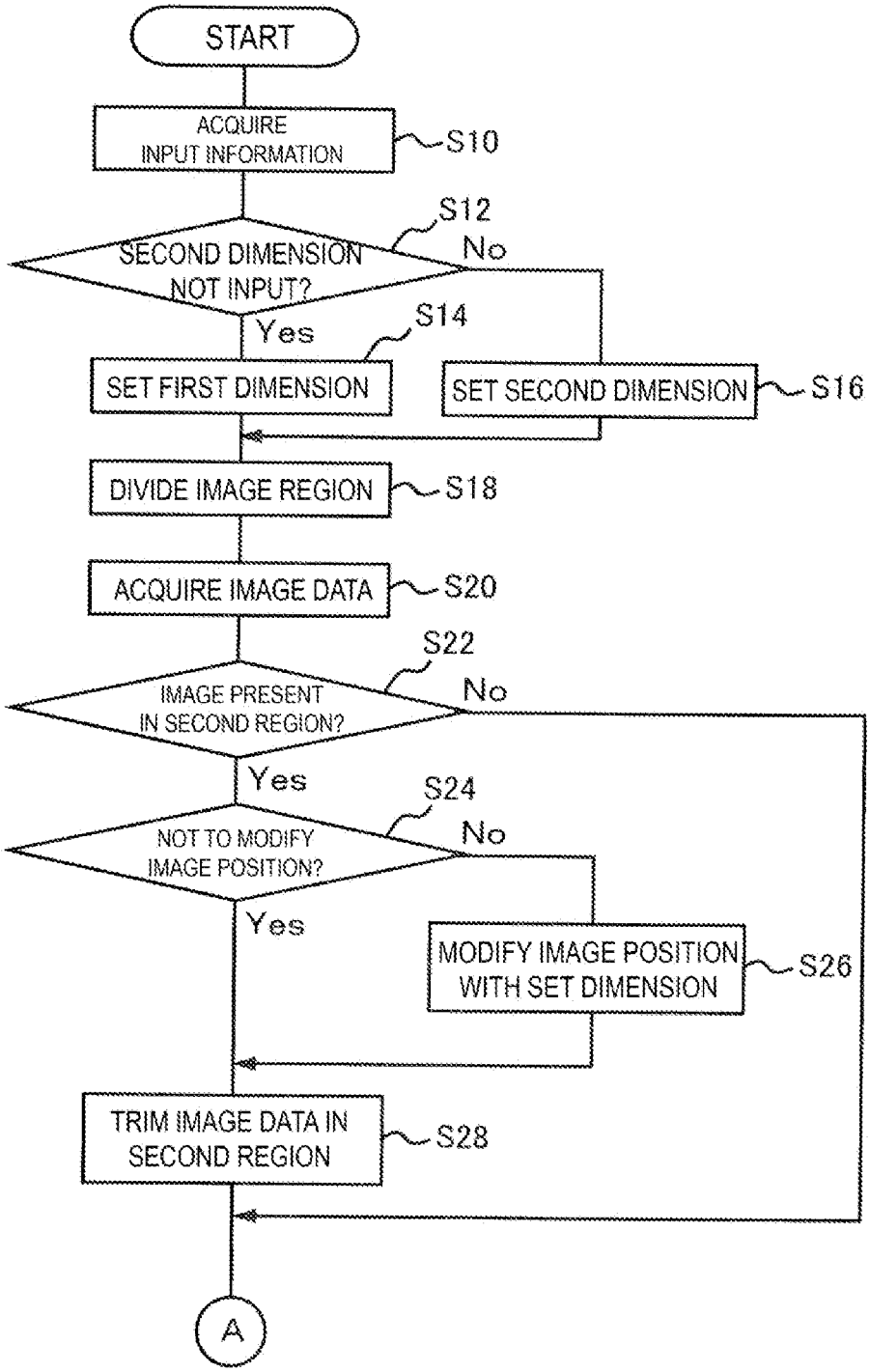
FIG. 10A is a first half of a flowchart illustrating a flow of respective processes performed in the recording system according to the present exemplary embodiment.
Figure 10B:
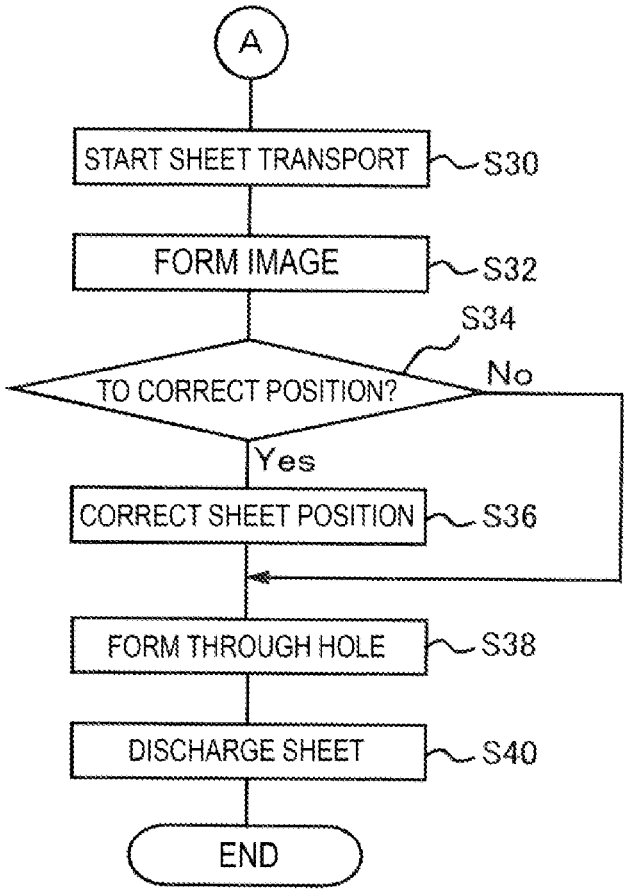
FIG. 10B is a second half of the flowchart illustrating the flow of the respective processes performed in the recording system according to the present exemplary embodiment.

FIG. 10 is a flowchart illustrating a flow of respective processes from acquisition of information from the operation unit 15 by the control unit 24 until the sheet P is discharged. Each of the processes illustrated in FIG. 10 is performed by the CPU 25 that reads the program PR from the memory 26, and decompresses and executes the program PR.

In step S10, the CPU 25 acquires information of the second dimension L2*b* from the operation unit 15. Then, the processing proceeds to step S12.

In step S12, the CPU 25 proceeds to step S14 when the information of the second dimension L2*b* is not input in the operation unit 15, that is, when the second dimension L2*b* is not set (S12: Yes). When the information of the second dimension L2*b* is input in the operation unit 15 (S12: No), the processing proceeds to step S16.

In step S14, the CPU 25 sets the stored first dimension L2*a* as the set dimension L2 in the T direction of the second region S2. Then, the processing proceeds to step S18.

In step S16, the CPU 25 sets the second dimension L2*b* input in the operation unit 15 as the set dimension L2. Then, the processing proceeds to step S18.

In step S18, the CPU 25 divides the region S into the first region S1 and the second region S2 such that a dimension in the T direction of the second region S2 is the set dimension L2 (one example of a division step). Then, the processing proceeds to step S20.

In step S20, the CPU 25 acquires the image data DG. The acquisition of the image data DG may be acquisition from an external device different from the recording system 1, as well as acquisition by reading an original document in the scanner unit 12. Then, the processing proceeds to step S22.

In step S22, the CPU 25 applies image data DG to region S. That is, the CPU 25 checks which part of the image data DG is located at which part of the region S. When a part of the image data DG is present in the second region S2 (S22: Yes), the processing proceeds to step S24. When a part of the image data DG is not present in the second region S2 (S22: No), the processing proceeds to step S30.

In step S24, the CPU 25 determines whether to modify the position of the image G in the T direction or not, based on the information of the operation unit 15. In other words, when the modification for the position in the T direction of the image G is set by the operation unit 15, the CPU 25 determines to modify the position in the T direction of the image G. On the other hand, when the modification for the position in the T direction of the image G is not set by the operation unit 15, the CPU 25 determines not to modify the position in the T direction of the image G. When the position in the T direction of the image G is not modified (S24: Yes), the processing proceeds to step S28. When the position in the T direction of the image G is modified (S24: No), the processing proceeds to step S26.

In step S26, the CPU 25 sets the first dimension L2*a* or the second dimension L2*b* used in step S18 as an amount of position modification in the T direction of the image G as is, and modifies a position of the entire image data DG in the region S, in the T direction by the first dimension L2*a* or the second dimension L2*b*. In other words, the position where the image G is formed in the sheet P is shifted in the T direction. Then, the processing proceeds to step S28.

In step S28, the CPU 25 trims the image data DG in second region S2. That is, the CPU 25 clears the image data DG in the second region S2. Then, the processing proceeds to step S30.

In step S30, the CPU 25 starts transport of the sheet P from the cassette accommodation unit 14 by starting operation of the transport unit 28. Then, the processing proceeds to step S32.

In step S32, the CPU 25 causes the ejecting unit 22 to eject the ink Q to form a part of the image G only in the first region S1, and causes the discharge unit 22 not to eject the ink Q so that the image G is not formed in the second region S2 (one example of an image forming step). Then, the processing proceeds to step S34.

In step S34, the CPU 25 checks whether to correct the position of the sheet P in the punch unit 40 or not. As an example, the CPU 25 acquires information of whether to correct the position of the sheet P or not and information of a position correction amount from the operation unit 15. When the position of the sheet P is corrected (S34: Yes), the processing proceeds to step S36. When the position of the sheet P is not corrected (S34: No), the processing proceeds to step S38.

In step S36, the CPU 25 corrects the position in the T direction of the sheet P transported to the punch unit 40. Specifically, the CPU 25, assuming that transport velocity of the sheet P by the first roller pair 54 and the second roller pair 57 is constant, corrects the position in the T direction of the sheet P facing the punch unit 40, by modifying an elapse time from when a downstream end in the T direction of the sheet P is detected in the sheet sensor 52 to when the transport of the sheet P is stopped. Then, the processing proceeds to step S38.

In step S38, the CPU 25 operates the punch unit 40 with the transport unit 28 once stopped to form the two through holes A in the second region S2 of the sheet P. Then, the processing proceeds to step S40.

In step S40, the CPU 25 operates the transport unit 28 to transport the sheet P, and discharge the sheet P to the discharge tray 33. Then, the program PR is ended. Note that, when at least one of the image G and the through hole A is formed in another sheet P, the program PR is executed again.

As described above, according to the recording system 1, in the first region S1 of the sheet P, a part of the image G is formed by ejecting the ink Q from the ejecting unit 22 based on the image data DG.

On the other hand, in the second region S2 of the sheet P, the ejecting unit 22 does not eject the ink Q, and thus the image G is not formed in a band shape entirely in the Y direction.

Here, even when respective positions of the two through holes A are shifted from respective set positions when the punch unit 40 forms the two through holes A in the second region S2 of the sheet P, the image G is not formed in the second region S2, so the position of the image G and the respective positions of the two through holes A are not compared, and a position shift of the two through holes A is prevented from being conspicuous.

Furthermore, according to the recording system 1, of the image data DG, the image data DG corresponding to the second region S2 is removed in a band shape, therefore, the control unit 24 does not need to perform a process of locating the respective positions of the two through holes A, and a process of removing the image data DG in accordance with the respective positions of the two through holes A, therefore, a load of the control unit 24 can be reduced.

Similar effects can also be obtained in the control method for the recording system 1 and the control program for the recording system 1.

Note that, when the ink Q is ejected onto the sheet P and the sheet P is inflated, elasticity of the sheet P decreases, and the through hole A is formed, shear failure tends to occur. When shear failure occurs, there is a possibility that the through hole A may be misshapen rather than being formed in a circular shape, and a punch scrap is sandwiched between the punch unit 42 and the stand 46 without being completely separated from the sheet P, and the punch unit 42 is caught. Here, in the recording system 1, the ink Q is not ejected onto and near the through hole A, so shape failure of the through hole A and jam of the punch unit 42 are easily avoided.

According to the recording system 1, the dimension in the T direction of the second region S2 can be freely set by the operation unit 15, and thus the image G in the first region S1 along an intention of the user can be obtained.

According to the recording system 1, the control unit 24, when the shift of the position of the image G is selected through the operation unit 15, causes the ejecting unit 22 to eject the ink Q so that the position of the image G formed in the first region S1 is shifted by the set dimension L2. As a result, there is no need to set an amount of shift in the T direction of the image G formed in the first region S1 each time, and thus convenience of the recording system 1 is improved.

According to the recording system 1, when the sheet P having a different thickness is used, the set dimension L2 in the T direction of the second region S2 in accordance with the sheet P can be determined, based on a relationship between the thickness data of the sheet P stored in the memory 26, and the dimension data in the T direction of the second region S2 corresponding to the thickness data.

When the dimension of the image data DG is changed, a state of a curl and cockling of the sheet P may change due to a change in ink content of the sheet P, which may cause a position shift of the through hole A. The curl and cockling of the sheet P are also changed depending on the sheet thickness. Here, according to the recording system 1, by storing such a data table DT, a combination of sheet thickness and dimension can be proposed to the user. Specifically, the display unit 17 is capable of displaying the data table DT, and the set dimension L2 as the dimension data is selectable, as such, within a range of the data table DT, the set dimension L2 as desired by the user can be set.

According to the recording system 1, the modification unit 50 corrects the position in the T direction of the sheet P based on the correction data input to the control unit 24. As a result, a position shift of the image G with respect to the two through holes A can be corrected uniformly in the T direction.

According to the recording system 1, compared to a configuration in which the control unit 24 controls the punch unit 40 to form the two through holes A in the sheet P after waiting for the ink Q to be dried, a time required for the two through holes A to be formed in the sheet P after the ink Q is ejected from the ejecting unit 22 is shortened, and thus throughput of image formation on the sheet P in the recording system 1 can be increased.

According to the recording system 1, compared to a configuration in which the image G is formed in the second region S2, a total time required for the image forming processing to form the image G on the sheet P and the inspection processing of the state of the ejecting unit 22 by the nozzle inspection unit 23 is shortened, as a result, throughput of image formation on the sheet P in the recording system 1 can be increased.

The recording system 1, the control method for the recording system 1, and the control program for the recording system 1 according to the exemplary embodiments of the present disclosure are based on the configuration described above. However, as a matter of course, modifications, omission, and the like may be made to a partial configuration without departing from the gist of the disclosure of the present application.

Figure 11:
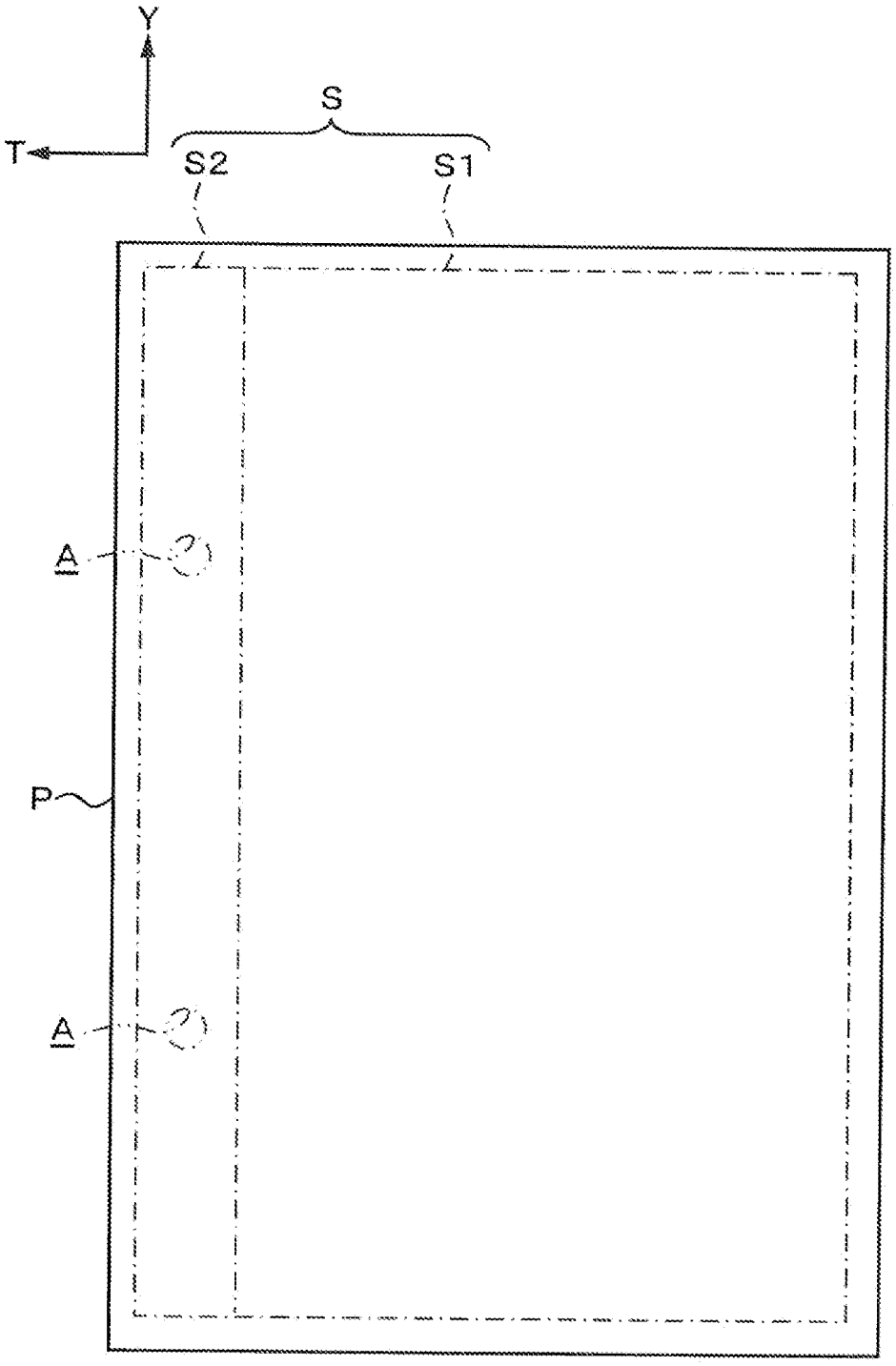
FIG. 11 is a plan view illustrating a region in which an image can be formed in a sheet used in a recording system according to a modification example.

As illustrated in FIG. 11, in the sheet P, the second region S2 may be located downstream the first region S1 in the T direction. In this case, it is sufficient that the punch unit 40 is disposed at a position adjacent to the first roller pair 54.

In the recording system 1, division into the first region S1 and the second region S2 may be performed using the first dimension L2*a* preset by the memory 26 without providing the operation unit 15. The operation unit 15 need not be configured to enable selection of whether to shift the position of the image G in the T direction. The memory 26 may store, in the data table DT, profile dimension data of the sheet P or a paper type of the sheet P as a parameter, instead of the thickness data of the sheet P.

A value in the data table DT may be set to a value other than the value illustrated in FIG. 6.

The correction data is not limited to the data input from the operation unit 15, but may be data input from an external device different from the recording system 1, or data stored in advance in the memory 26.

In the recording system 1, as a definition of undried, it is desirable that a time is set to within 3 [seconds], and more desirably within 2 [seconds], rather than 6 [seconds]. Additionally, as a definition of undried, a time with which a time from when ejection of the ink Q from the ejecting unit 22 is started, to when the sheet P faces the punch unit 40 is 6 [seconds] or greater may be defined. The control unit 24 need not cause the nozzle inspection unit 23 to inspect the state of the ejecting unit 22, at the time when the ejecting unit 22 faces the second region S2 of the sheet P.

The control unit 24 may mask the data of the remaining part of the image G in the second region S2, rather than trimming.

In the recording system 1, during inspection by the nozzle inspection unit 23, ink Q may be ejected onto the subsequent sheet P. In other words, image formation of the second or subsequent sheet P may be started.

The medium is not limited to the sheet P, and may be film, cloth, or the like.

The number of through holes A is not limited to two, and may be three or more.

Methods for changing the set dimension L2 according to a sheet thickness includes, a method in which the control unit 24 determines the dimension in the Y direction of the image data DG, and a method in which the control unit 24 limits a width of a dimension that can be specified by a user, a method in which the control unit 24 proposes a desirable dimension for a user, and a method in which whether or not to use, in addition to a change in the position in the T direction of the image G, a change in the position and removal of the image data DG in combination is switched.

Note that, as the correction data, in addition to the correction data input from the operation unit 15, and the correction data acquired by the image reading unit 60, correction data set based on an original document read by the scanner unit 12 may be used.

What is claimed is:

1. A liquid ejecting device, comprising:

an ejecting unit configured to eject liquid onto a medium transported by a transport unit to form an image;

a hole forming unit configured to form a plurality of through holes, arranged in a width direction intersecting a transport direction of the medium;

an operation unit; and a control unit configured to control ejection of the liquid based on image data, wherein the control unit divides a region in the medium, configured to be formed with an image based on the image data, into a first region, and a second region that is aligned with the first region in the transport direction and in which the plurality of through holes are formed, causes the ejecting unit to eject the liquid, based on the image data, in the first region to form a part of the image, and causes the ejecting unit not to eject the liquid in the second region, the control unit performs division into the first region and the second region so that a dimension in the transport direction of the second region is a set dimension set through the operation unit, the operation unit is configured to enable setting of a dimension in the transport direction of the second region and configured to enable selection of whether to shift the position of the image in the transport direction, and the control unit causes the ejecting unit to eject the liquid so that the position of the image formed in the first region is shifted by the set dimension.

2. The liquid ejecting device according to claim 1, wherein the control unit includes a storage unit for storing a data table, and the storage unit stores, in the data table, thickness data of the medium, and dimension data in the transport direction of the second region corresponding to the thickness data.

3. The liquid ejecting device according to claim 2, comprising:

a display unit configured to display the data table and enable selection of the dimension data, wherein the control unit stores the dimension data selected in the display unit.

4. The liquid ejecting device according to claim 1, comprising:

a modification unit configured to modify a position in the transport direction of the medium transported to the hole forming unit, wherein the control unit is configured to accept input of correction data for correcting a position in the transport direction of the medium, and operates the modification unit based on the input correction data, to correct the position in the transport direction of the medium.

5. The liquid ejecting device according to claim 1, wherein the control unit, in a state in which the liquid ejected from the ejecting unit onto the medium is undried, causes the transport unit to transport the medium so that the through hole is formed in the medium.

6. The liquid ejecting device according to claim 1, comprising:

an inspection unit configured to inspect a state of the ejecting unit, wherein the control unit causes the inspection unit to inspect a state of the ejecting unit, in a time in which the ejecting unit faces the second region of the medium.

7. A control method for a liquid ejecting device that includes an ejecting unit for ejecting liquid onto a medium transported by a transport unit to form an image, a hole forming unit for forming a plurality of through holes, arranged in a width direction intersecting a transport direction of the medium, an operation unit, and a control unit for controlling ejection of the liquid based on image data, the control method comprising:

dividing a region in the medium, configured to be formed with an image based on the image data, into a first region, and a second region that is aligned with the first region in the transport direction and in which the plurality of through holes are formed;

causing the ejecting unit to eject the liquid based on the image data in the first region to form a part of the image, and causing the ejecting unit not to eject the liquid in the second region; and causing the ejecting unit to eject the liquid so that the position of the image formed in the first region is shifted by a set dimension of the second region, wherein the operation unit is configured to enable setting of a dimension in the transport direction of the second region and configured to enable selection of whether to shift the position of the image in the transport direction.

8. A non-transitory computer-readable storage medium storing a control program for a liquid ejecting device that includes an ejecting unit for ejecting liquid onto a medium transported by a transport unit to form an image, a hole forming unit for forming a plurality of through holes, arranged in a width direction intersecting a transport direction of the medium, an operation unit, and a control unit for controlling ejection of the liquid based on image data, the control program causing a computer to:

divide a region in the medium, configured to be formed with an image based on the image data, into a first region, and a second region that is aligned with the first region in the transport direction and in which the plurality of through holes are formed;

cause the ejecting unit to eject the liquid based on the image data in the first region to form a part of the image, and causing the ejecting unit not to eject the liquid in the second region; and cause the ejecting unit to eject the liquid so that the position of the image formed in the first region is shifted by a set dimension of the second region, wherein the operation unit is configured to enable setting of a dimension in the transport direction of the second region and configured to enable selection of whether to shift the position of the image in the transport direction.

* * * * *